US011054103B2

(12) United States Patent
Choi et al.

(10) Patent No.: US 11,054,103 B2
(45) Date of Patent: Jul. 6, 2021

(54) VEHICLE LAMP

(71) Applicant: SL Corporation, Daegu (KR)

(72) Inventors: Nak Jung Choi, Gyeongsan-si (KR); Jong Woon Kim, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/885,486

(22) Filed: May 28, 2020

(65) Prior Publication Data

US 2020/0386382 A1 Dec. 10, 2020

(30) Foreign Application Priority Data

Jun. 10, 2019 (KR) ..... 10-2019-0068016

(51) Int. Cl.

| | |
|---|---|
| ***F21S 41/20*** | (2018.01) |
| ***F21S 41/40*** | (2018.01) |
| ***F21S 43/20*** | (2018.01) |
| ***F21V 5/00*** | (2018.01) |

(52) U.S. Cl.

CPC ..... *F21S 41/285* (2018.01); *F21S 41/40* (2018.01); *F21S 43/26* (2018.01); *F21V 5/007* (2013.01); *F21V 5/008* (2013.01)

(58) Field of Classification Search

None

See application file for complete search history.

(56) References Cited

U.S. PATENT DOCUMENTS

| | | | | |
|---|---|---|---|---|
| 10,232,763 | B1 | 3/2019 | Eckstein et al. | |
| 10,612,741 | B2 | 4/2020 | Moser et al. | |
| 2019/0017681 | A1* | 1/2019 | Hoshino | F21S 41/25 |
| 2019/0072252 | A1* | 3/2019 | Moser | F21S 41/686 |

FOREIGN PATENT DOCUMENTS

| | | | |
|---|---|---|---|
| DE | 10 2017 108 512 | A1 | 10/2018 |
| DE | 10 2017 112 971 | A1 | 12/2018 |
| DE | 10 2018 101 991 | B3 | 5/2019 |
| WO | 2017/066818 | A1 | 4/2017 |

OTHER PUBLICATIONS

Extended European Search Report, European Application No. 20176734.0, dated Oct. 28, 2020, 9 pages.

* cited by examiner

*Primary Examiner* — Ashok Patel

(74) *Attorney, Agent, or Firm* — Nelson Mullins Riley & Scarborough LLP; Kongsik Kim, Esq.

(57) ABSTRACT

A lamp for a vehicle includes a light source unit; a first optical member in which a plurality of incident lenses are arranged on an incident surface thereof; a second optical member in which a plurality of exit lenses are arranged on an exit surface thereof; and a shield unit including a plurality of shields disposed between the plurality of incident lenses and the plurality of exit lenses. The incident surface of the first optical member and the exit surface of the second optical member are inclined, and an incident surface of a first incident lens among the plurality of incident lenses and an exit surface of a first exit lens corresponding to the first incident lens among the plurality of exit lenses are formed asymmetrically with respect to a reference line drawn to pass through a focal point between the first incident lens and the first exit lens.

14 Claims, 12 Drawing Sheets

| LENS SHAPE | LENS ARRANGEMENT |
|---|---|
| SYMMETRY |  |
| ASYMMETRY |  |

VEHICLE LAMP

CROSS-REFERENCE TO RELATED APPLICATION

This application claims the benefit of priority from Korean Patent Application No. 10-2019-0068016 filed on Jun. 10, 2019, the contents of which in their entirety are herein incorporated by reference.

BACKGROUND

1. Technical Field

The present disclosure relates to a vehicle lamp, and more particularly, to a vehicle lamp capable of preventing light from being irradiated in an unnecessary direction.

2. Description of the Related Art

Generally, a vehicle is equipped with various types of vehicle lamps having an illumination function for illuminating an object disposed near the vehicle in low light conditions (e.g., nighttime driving), and a signal function for notifying other vehicles or road users of the operating state of the vehicle.

For example, the main purpose of head lamps and fog lamps is the illumination function, and the main purpose of turn signal lamps, tail lamps, brake lamps, or side markers is the signal function. In addition, the installation standards and specifications of such vehicle lamps are stipulated by regulations to ensure each function to be fully utilized.

Recently, studies have been actively conducted to reduce the size of the vehicle lamp using a micro lens having a relatively short focal length.

Among vehicle lamps, the head lamp forms various beam patterns such as a low beam pattern or a high beam pattern to secure a front view of a driver at nighttime driving, and it plays an important role in operation safety. In particular, the low beam pattern forms a predetermined cut-off line to prevent the occurrence of glare to a driver of a front vehicle such as a preceding vehicle or an on-coming vehicle.

When forming a low beam pattern using a micro lens, the low beam pattern is formed by light emitted from a plurality of micro lenses, and a plurality of shields are provided to obstruct a portion of light incident on each of the plurality of micro lenses to form a cut-off line.

Such a vehicle lamp may have various designs depending on the shape of an exterior surface of the vehicle, for example, the shape of a cover lens that allows light to be irradiated to the outside of the vehicle. The plurality of micro lenses may be arranged to be inclined in a predetermined direction depending on the shape of the cover lens. Therefore, when a step is formed between micro lenses adjacent to each other, there is a possibility that the light is irradiated in an unnecessary direction.

Accordingly, there is a demand for a method for preventing light from being irradiated in an unnecessary direction by preventing a step between the micro lenses adjacent to each other even when the plurality of micro lenses are arranged to be inclined.

SUMMARY

Aspects of the present disclosure provide a vehicle lamp in which when a plurality of incident lenses and a plurality of exit lenses are arranged to be inclined at a predetermined angle, a step may be prevented from forming between incident lenses adjacent to each other and exit lenses adjacent to each other, thereby preventing light from being irradiated in an unnecessary or unintended direction due to the step.

However, aspects of the present disclosure are not restricted to those set forth herein. The above and other aspects of the present disclosure will become more apparent to one of ordinary skill in the art to which the present disclosure pertains by referencing the detailed description of the present disclosure given below.

According to an aspect of the present disclosure, a lamp for a vehicle may include a light source unit; a first optical member in which a plurality of incident lenses are arranged on an incident surface thereof to which light generated from the light source unit is incident; a second optical member in which a plurality of exit lenses are arranged on an exit surface thereof from which the light incident from the first optical member is emitted; and a shield unit including a plurality of shields disposed between the plurality of incident lenses and the plurality of exit lenses. In particular, the incident surface of the first optical member and the exit surface of the second optical member may be inclined to allow first sides to be closer to the light source unit than second sides, and an incident surface of a first incident lens among the plurality of incident lenses and an exit surface of a first exit lens that corresponds to the first incident lens among the plurality of exit lenses may be formed asymmetrically with respect to a reference line drawn to pass through a focal point disposed between the first incident lens and the first exit lens.

The shield unit may comprise a plurality of first shields configured to obstruct a portion of light incident on the plurality of exit lenses; and a plurality of second shields disposed in front of the plurality of first shields. The plurality of first shields and the plurality of second shields may be formed on an incident surface and an exit surface of one of the first optical member or the second optical member. A top line of each of the plurality of first shields may be disposed at or near a focal point between corresponding incident lens and exit lens among the plurality of incident lenses and the plurality of exit lenses. Further, a top line of each of the plurality of second shields may be disposed below a top line of a corresponding first shield among the plurality of first shields.

The reference line may be parallel to an optical axis of the light source unit. An incident surface of each of the plurality of incident lenses may be continuously formed with an incident surface of an adjacent incident lens without a surface interposed therebetween, and an exit surface of each of the plurality of exit lenses may be continuously formed with an exit surface of an adjacent exit lens without a surface interposed therebetween.

The first incident lens and the first exit lens may be offset from each other with respect to the reference line. A first side of the incident surface of the first incident lens may have a smaller area than a second side thereof with respect to the reference line, and a first side of the exit surface of the first exit lens may have a greater area than a second side thereof with respect to the reference line. In particular, the first side of incident surface of the first incident lens may correspond to a side closer to the light source unit, and the first side of the exit surface of the first exit lens may correspond to a side closer to the light source unit.

Each of the plurality of incident lenses may be a semi-cylindrical lens that extends in a predetermined direction, and light emitted from each of the plurality of incident lenses may be incident on at least two of the plurality of exit lenses. The incident surface of the first optical member may include a central region, lateral regions disposed on both sides of the central region, and an outer region disposed outside the central region and the lateral regions, and numbers of exit lenses arranged to correspond to an incident lens may increase in the order of the central region, the lateral regions, and the outer region. For example, light emitted from an incident lens in the central region may be incident on two exit lenses, light emitted from an incident lens in the lateral regions may be incident on three exit lenses, and light emitted from an incident lens in the outer region may be incident on four exit lenses. The central region may form a high illuminance region of a beam pattern, the lateral regions may form a spread region of the beam pattern, and the outer region may form an extended region of the beam pattern that expands the spread region.

A vehicle lamp according to the present disclosure has one or more of the following benefits. Corresponding incident lenses and the exit lenses among the plurality of incident lenses and the plurality of exit lenses may be formed asymmetrically with respect to a reference line drawn to pass through a focal point disposed between the corresponding incident lenses and the exit lenses. As a result, even when the plurality of incident lenses and the plurality of exit lenses are arranged to be inclined, a step may be prevented from occurring between the incident lenses adjacent to each other and between the exit lenses adjacent to each other. Therefore, there is a benefit that light may be prevented from being irradiated in the unnecessary or unintended direction through the step.

The benefits of the present disclosure are not limited to the above-mentioned benefits, and other benefits not mentioned may be clearly understood by a person skilled in the art from the claims.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
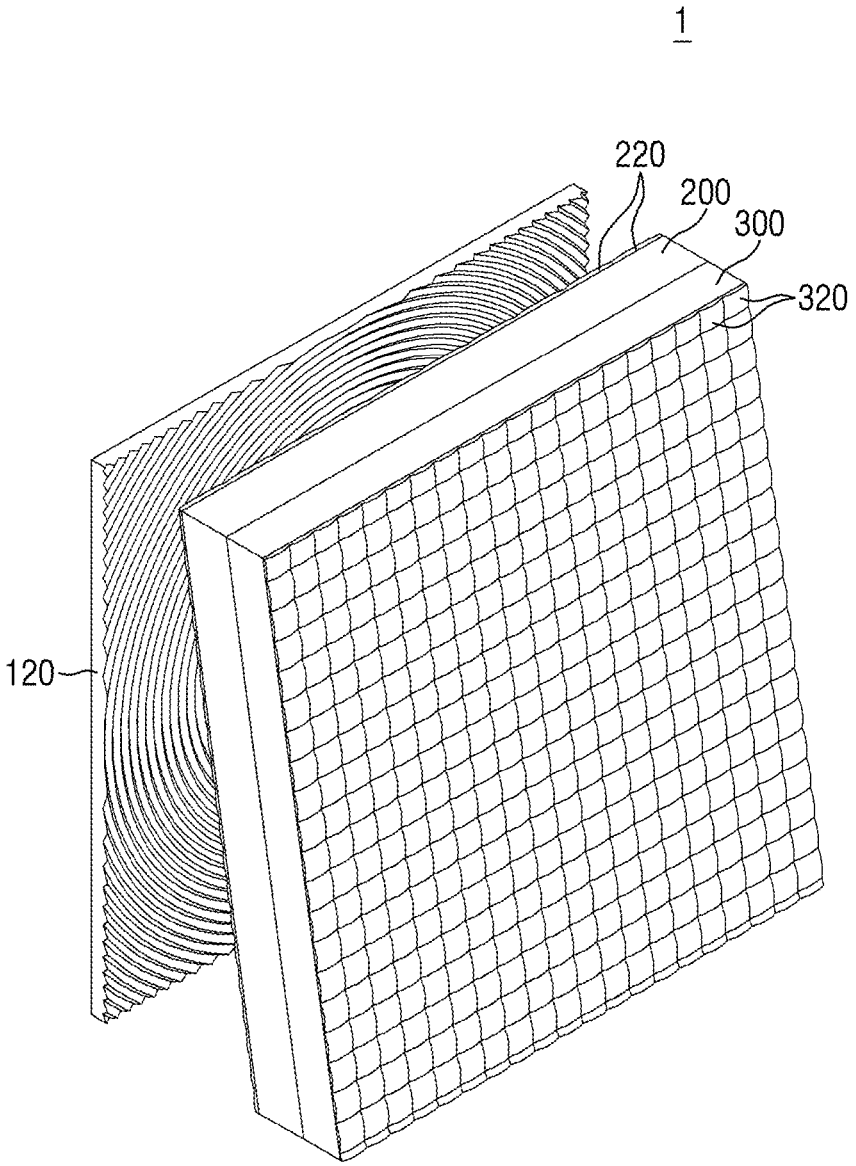
FIGS. 1 and 2 are perspective views showing a vehicle lamp according to an exemplary embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Throughout the specification, like reference numerals in the drawings denote like elements.

In some exemplary embodiments, well-known steps, structures and techniques will not be described in detail to avoid obscuring the disclosure.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the disclosure are described herein with reference to plan and cross-sectional illustrations that are schematic illustrations of idealized exemplary embodiments of the disclosure. As such, variations from the shapes of the illustrations as a result, for example, of manufacturing techniques and/or tolerances, are to be expected. Thus, exemplary embodiments of the disclosure should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for explaining a vehicle lamp according to exemplary embodiments of the present disclosure.

Figure 2:
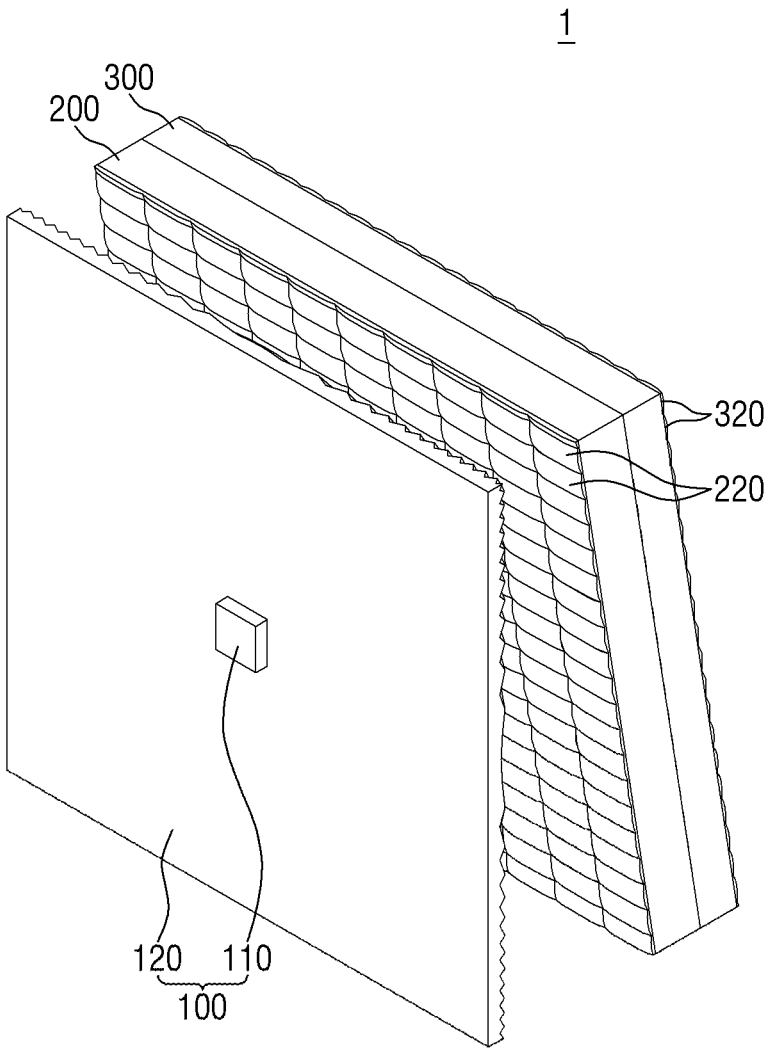
Figure 3:
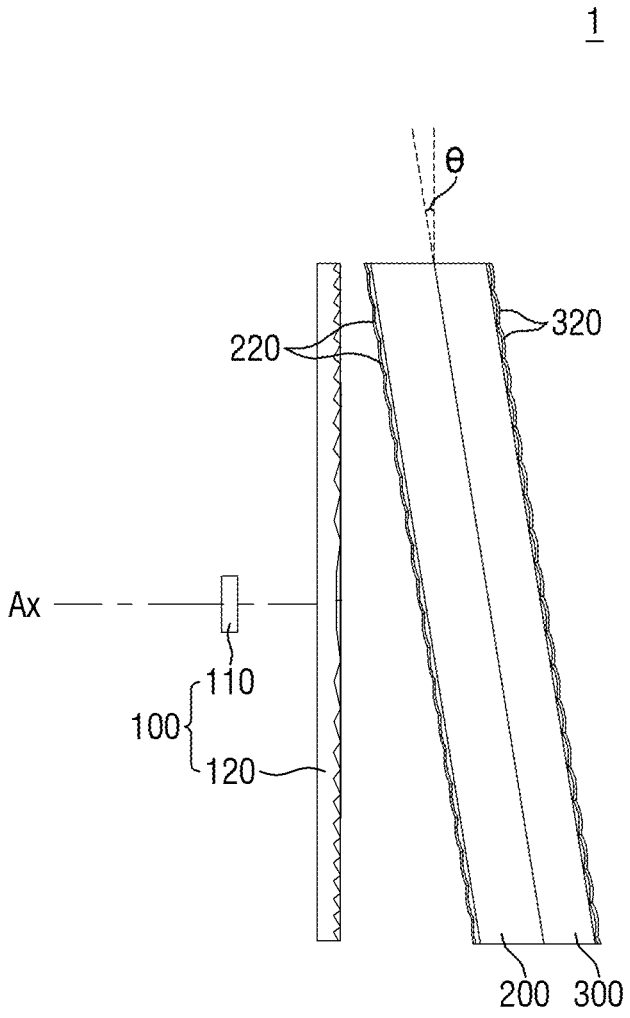
FIG. 3 is a side view showing the vehicle lamp according to the exemplary embodiment of the present disclosure.
Figure 4:
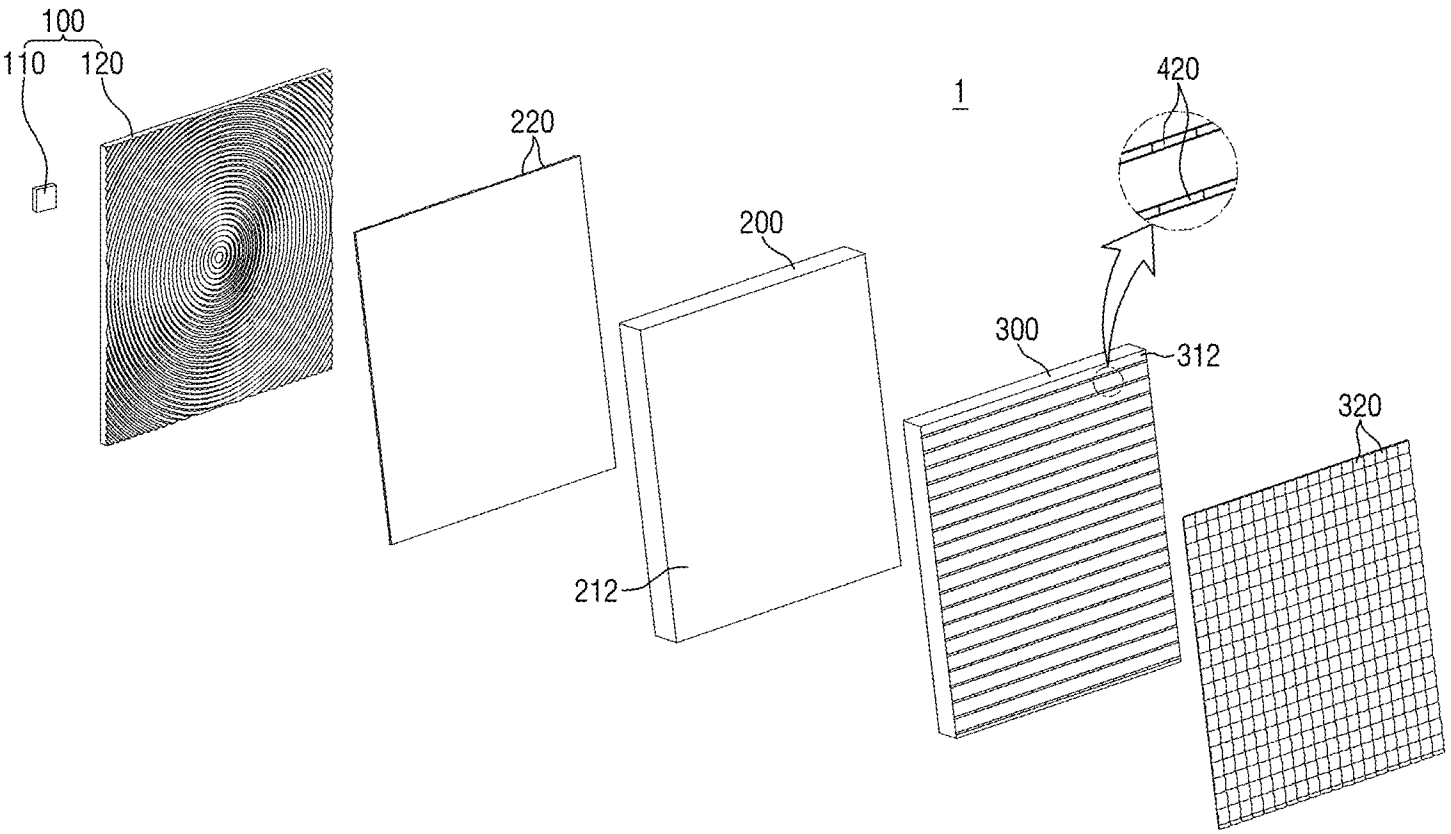
FIGS. 4 and 5 are exploded perspective views showing the vehicle lamp according to the exemplary embodiment of the present disclosure.
Figure 5:
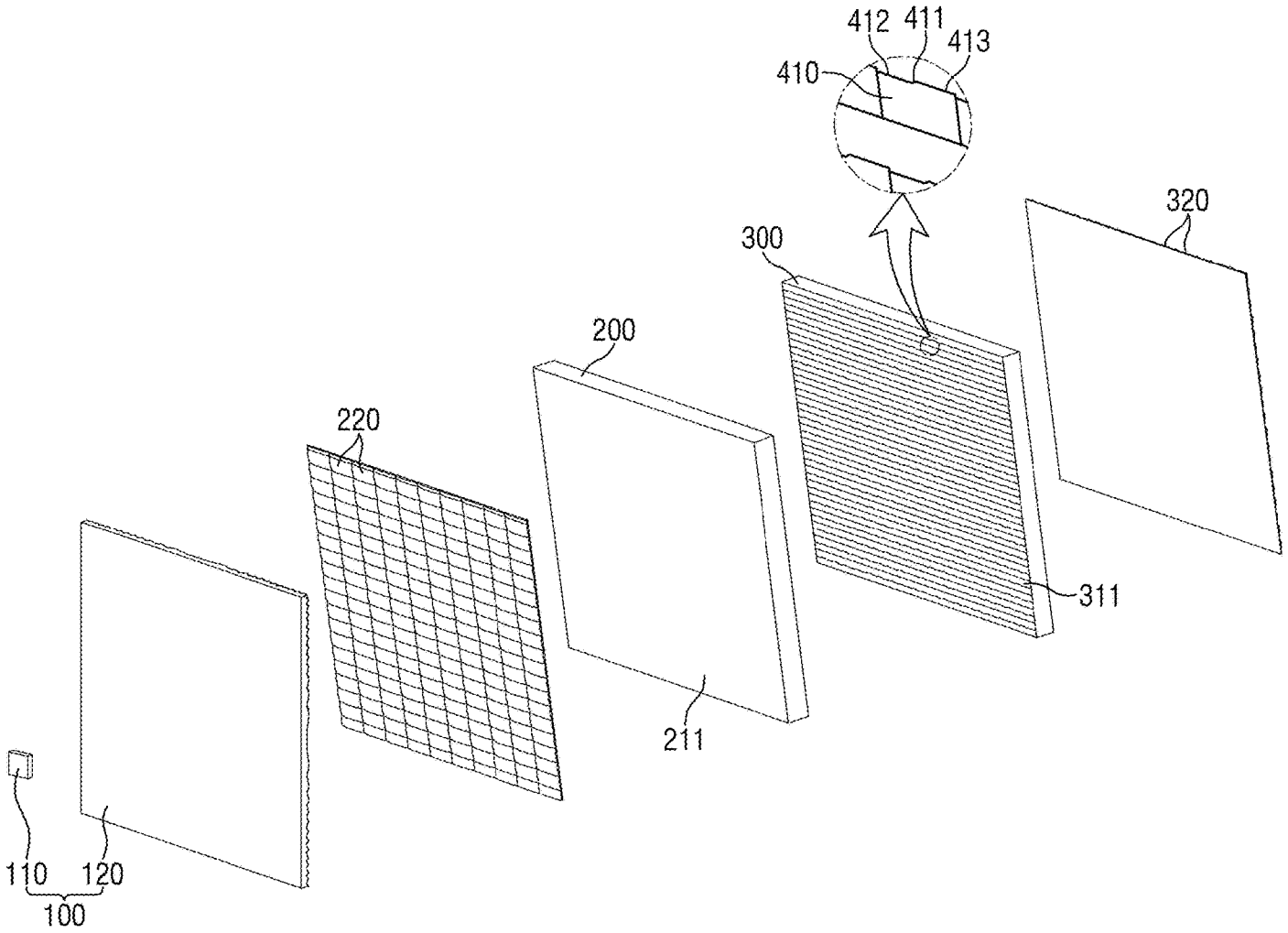

FIGS. 1 and 2 are perspective views showing a vehicle lamp according to an exemplary embodiment of the present disclosure. FIG. 3 is a side view showing the vehicle lamp according to the exemplary embodiment of the present disclosure. FIGS. 4 and 5 are exploded perspective views showing the vehicle lamp according to the exemplary embodiment of the present disclosure. Referring to FIGS. 1 to 5, a vehicle lamp 1 according to an exemplary embodiment of the present disclosure may include a light source unit 100, a first optical member 200, a second optical member 300, and a shield unit 400. The light source unit 100, the first optical member 200, the second optical member 300, and the shield unit 400 may be accommodated in an internal space formed by a lamp housing (not shown) and a cover lens (not shown) coupled to the lamp housing to allow light to be irradiated to the outside of a vehicle.

In an example of the exemplary embodiment of the present disclosure, the vehicle lamp 1 may be a head lamp used for the purpose of securing a front view by irradiating light in a proceeding direction of a vehicle when the vehicle drives at night or in a dark place such as a tunnel or the like. However, the vehicle lamp 1 according to the exemplary embodiment of the present disclosure is not limited thereto, and it may be used as various lamps installed in a vehicle such as a tail lamp, a brake lamp, a fog lamp, a position lamp, a turn signal lamp, a daytime running lamp (DRL), a backup lamp, or the like.

Further, in the exemplary embodiment of the present disclosure, the vehicle lamp 1 may form a low beam pattern in which light is irradiated to a lower side with respect to a predetermined cut-off line to prevent glare from occurring to a driver of a front vehicle such as a preceding vehicle or an on-coming vehicle. However, the present disclosure is not limited thereto, and a high beam pattern that ensures a long distance field of view in front of a vehicle may also be formed with the vehicle lamp 1 of the present disclosure. The beam pattern formed according to the use of the vehicle lamp 1 of the present disclosure may be variously changed.

The light source unit 100 may include a light source 110 and an optical path adjusting unit 120. In the exemplary embodiment of the present disclosure, the light source 110 may be implemented as a semiconductor light emitting device such as an LED. However, the light source 110 is not limited thereto, and a semiconductor light emitting device and various types of light sources such as a bulb may be used as the light source 110. Depending on the type of the light source 110, a reflector or the like for reflecting the light generated from the light source 110 to the first optical member 200 may be additionally used.

The optical path adjusting unit 120 may adjust an optical path to cause the light generated at a predetermined light irradiation angle from the light source 110 to proceed approximately parallel to an optical axis Ax of the light source 110 and be incident on the first optical member 200. Here, it may be understood that the optical axis Ax of the light source 110 is a line passing perpendicularly through a center of a light exit surface of the light source 110, and it may be understood that the optical axis Ax of the light source 110 is the optical axis Ax of the light source unit 100.

The optical path adjusting unit 120 may allow the light generated from the light source 110 to be maximally incident on the first optical member 200, thereby reducing light loss. In addition, the optical path adjusting unit 120 may adjust the optical path so that the light incident on the first optical member 200 becomes parallel light that is parallel to the optical axis Ax of the light source 110, thereby the light generated from the light source 110 to be uniformly incident on the entire first optical member 200. Accordingly, a beam pattern formed by the vehicle lamp 1 of the present disclosure may have a uniform brightness.

In an example of the exemplary embodiment of the present disclosure, the optical path adjusting unit 120 may include a Fresnel lens consisting of several annular lenses, and thus, the optical path of light generated from the light source 110 may be adjusted to be parallel to the optical axis Ax of the light source 110 while reducing the thickness of the optical path adjusting unit 120. However, the optical path adjusting unit 120 is not limited thereto, and various types of lenses capable of adjusting the optical path of light generated from the light source 110 such as a collimator lens may be used.

The first optical member 200 may be disposed in front of the light source unit 100 and may emit the light incident from the light source unit 100 to the second optical member 300 disposed in front of the first optical member 200. The first optical member 200 may be formed of a material through which light is transmitted (e.g., optically transparent or translucent) so that light incident from the light source unit 100 through an incident surface 211 may be emitted through an exit surface 212, and a plurality of incident lenses 220 may be arranged on the incident surface 211 of the first optical member 200.

In the exemplary embodiment of the present disclosure, the plurality of incident lenses 220 may be formed separately from the first optical member 200 and attached to the incident surface 211 of the first optical member 200. However, the present disclosure is not limited thereto, and the first optical member 200 and the plurality of incident lenses 220 may be integrally manufactured. The plurality of incident lenses 220 may be micro lenses having a relatively short focal length to decrease the overall size of the vehicle lamp 1 of the present disclosure.

In addition, when it refers that the first optical member 200 is disposed in front of the light source unit 100 and the second optical member 300 is disposed in front of the first optical member 200, the direction is based on a configuration where a direction in which light is emitted from the vehicle lamp 1 of the present disclosure is defined as the front. The absolute direction of the front may vary depending on a position or orientation in which the vehicle lamp 1 of the present disclosure is installed.

In the exemplary embodiment of the present disclosure, the incident surface 211 of the first optical member 200 may be formed to be inclined at a predetermined angle θ with respect to the vertical plane so that one of opposing sides is closer to the light source unit 100 than the other. This configuration arises from a consideration of a shape of the exterior surface of the vehicle formed by the vehicle lamp 1 of the present disclosure. As an example, when at least a portion of the exterior surface of the cover lens observed from the outside of the vehicle to irradiate light to the outside of the vehicle is formed to be inclined or have a curvature vertically and/or horizontally, instead of a flat shape facing the front of the vehicle, the incident surface 211 of the first optical member 200 may need to be formed to be inclined so that the light is irradiated toward the front of the vehicle according to the shape of the exterior surface of the cover lens.

Hereinafter, in the exemplary embodiment of the present disclosure, the incident surface 211 of the first optical member 200 may be formed to be inclined such that an upper end is closer to the light source unit 100 than a lower end. However, the present disclosure is not limited thereto, and the incident surface 211 of the first optical member 200 may be formed to be inclined in at least one of the up-down (e.g., vertical) direction or the left-right (e.g., horizontal) direction.

The second optical member 300 may be formed of a material through which light is transmitted so that light incident from the first optical member 200 through the incident surface 311 may be emitted through the exit surface 312, and a plurality of exit lenses 320 may be arranged on the exit surface 312 of the second optical member 300.

In the exemplary embodiment of the present disclosure, the plurality of exit lenses 320 may be formed separately from the second optical member 300 and attached to the exit surface 312 of the second optical member 300. However, the present disclosure is not limited thereto, and the second optical member 300 and the plurality of exit lenses 320 may be integrally manufactured.

Similar to the plurality of incident lenses 220 described above, in the exemplary embodiment of the present disclosure, the plurality of exit lenses 320 may be micro lenses having a relatively short focal length to decrease the overall size of the vehicle lamp 1 of the present disclosure.

In the exemplary embodiment of the present disclosure, for similar reasons as described above with regards to the incident surface 211 of the first optical member 200, the exit surface 312 of the second optical member 300 may be formed to be inclined at the predetermined angle θ with respect to the vertical plane so that one of the opposing sides is closer to the light source unit 100 than the other. In the exemplary embodiment of the present disclosure, the incident surface 211 of the first optical member 200 may be formed to be inclined such that the upper end is closer to the light source unit 100 than the lower end. Therefore, the exit surface 312 of the second optical member 300 may be also formed to be inclined such that an upper end is closer to the light source unit 100 than a lower end.

In other words, the incident surface 211 of the first optical member 200 and the exit surface 312 of the second optical member 300 may be formed to be inclined at the same angle θ with respect to a plane perpendicular to the optical axis Ax of the light source unit 100. In this case, the exit surface 212 of the first optical member 200 and the incident surface 311 of the second optical member 300 may also be formed to be inclined at the same angle θ as the incident surface 211 of the first optical member 200 and the exit surface 312 of the second optical member 300. This configuration may improve convenience in manufacturing, and may ensure that a distance between the incident lens and the exit lens corresponding to each other among the plurality of incident lenses 220 and the plurality of exit lenses 320 is consistent.

Figure 6:
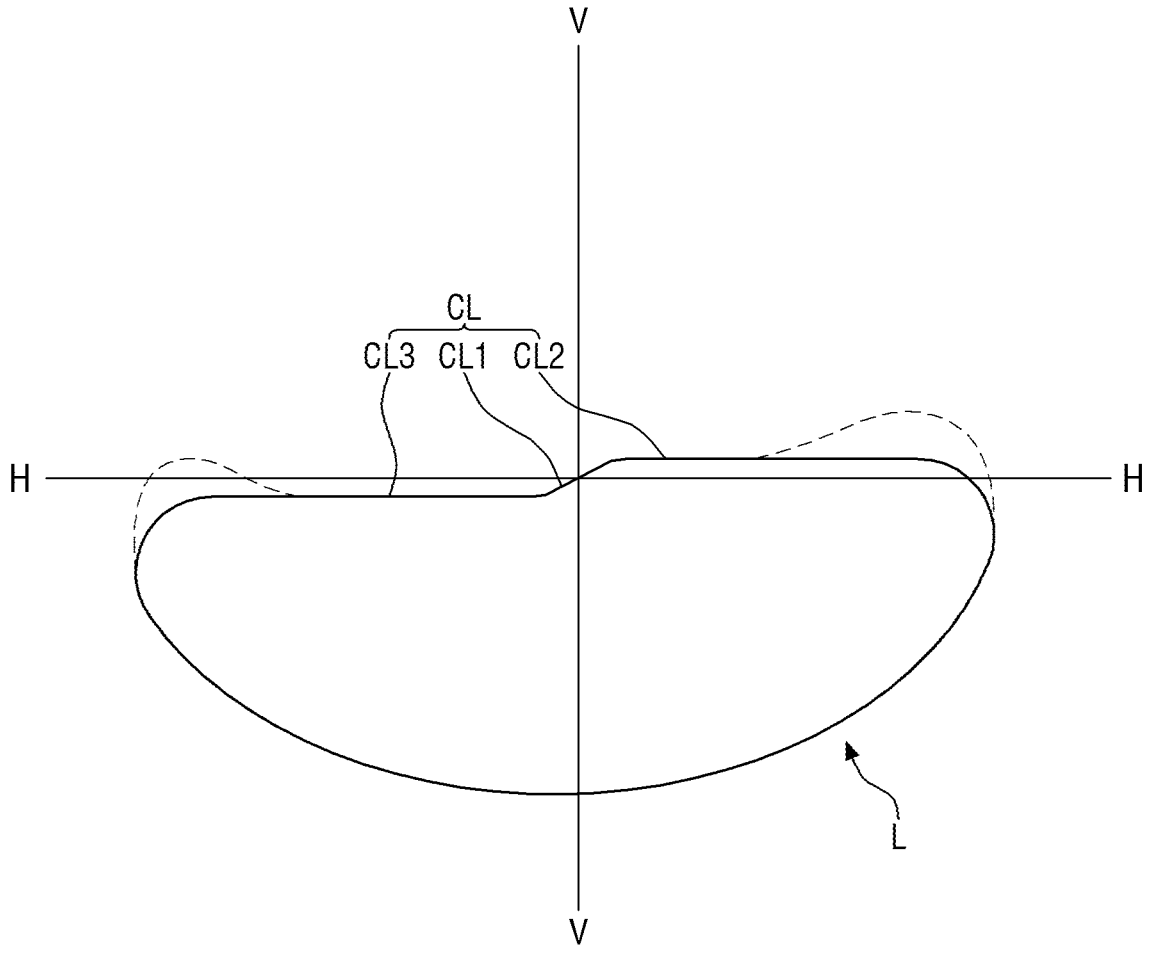
FIG. 6 is a schematic view showing a beam pattern formed by the vehicle lamp according to the exemplary embodiment of the present disclosure.

The shield unit 400 may be disposed between the plurality of incident lenses 220 and the plurality of exit lenses 320 to obstruct a portion of light incident on each of the plurality of exit lenses 320. Therefore, the shield unit 400 may form a low beam pattern, which is a beam pattern L having a predetermined cut-off line CL, as shown in FIG. 6. Here, the beam pattern L of FIG. 6 is an example of a beam pattern that may be formed when light is irradiated on a screen disposed at a predetermined distance in front of a vehicle in which the vehicle lamp 1 of the present disclosure is installed.

The shield unit 400 may include a plurality of first shields 410 and a plurality of second shields 420 formed by deposition or coating on at least one of the first optical member 200 or the second optical member 300.

In the exemplary embodiment of the present disclosure, a plurality of first shields 410 and a plurality of second shields 420 may be formed on the incident surface 311 and the exit surface 312 of the second optical member 300, respectively, such that positions of the plurality of first shields 410 and the plurality of second shields 420 are unchanged when the exit surface 212 of the first optical member 200 and the incident surface 311 of the second optical member 300 are disposed to contact each other. However, the present disclosure is not limited thereto, and the plurality of first shields 410 and the plurality of second shields 420 may be formed on the incident surface 211 and the exit surface 212 of the first optical member 200, respectively. Further, one of the plurality of first shields 410 and the plurality of second shields 420 may be formed on one of the incident surface 211 and the exit surface 212 of the first optical member 200, and the other may be formed on one of the incident surface 311 and the exit surface 312 of the second optical member 300.

When the plurality of first shields 410 and the plurality of second shields 420 are formed on the incident surface 311 and the exit surface 312 of the second optical member 300, respectively, the plurality of first shields 410 and the plurality of second shields 420 may be formed to be inclined at an angle corresponding to a forming angle θ of the incident surface 311 and the exit surface 312 of the second optical member 300.

An upper end (e.g., a top line, a top edge, or a top surface) of each of the plurality of first shields 410 may be disposed on a focal point F between a first incident lens 221 of the plurality of incident lenses 220 and a first exit lens 321 corresponding to the first incident lens 221 of the plurality of exit lenses 320, or near the focal point F, and may form the cut-off line CL of the beam pattern L of FIG. 6 described above. The plurality of second shields 420 may be disposed in front of the plurality of first shields 410, and may serve to horizontally form the cut-off line CL of the beam pattern L of FIG. 6 described above.

Here, it may be understood that the first incident lens 221 and the first exit lens 321 do not refer to a specific incident lens or a specific exit lens among the plurality of incident lenses 220 and the plurality of exit lenses 320, and it may mean an incident lens and an exit lens corresponding to each other among the plurality of incident lenses 220 and the plurality of exit lenses 320.

In the exemplary embodiment of the present disclosure, the cut-off line CL of the beam pattern L may include an inclined line CL1, an upper line CL2 connected to and horizontally extended from an upper end of the inclined line CL1, and a lower line CL3 connected to and horizontally extended from a lower end of the inclined line CL1. In this case, a top line of each of the plurality of first shields 410 may be formed with an inclined edge 411 that forms the inclined line CL1, a first edge 412 that forms the upper line CL2, and a second edge 413 that forms the lower line CL3.

The shape of the cut-off line CL of the beam pattern P described above is merely an example to help understanding of the present disclosure. The present disclosure is not limited thereto, and the shape of the cut-off line CL may be variously changed. A shape of the top line of the plurality of first shields 410 may also be changed depending on the desired shape of the cut-off line CL.

Each of the plurality of second shields 420 may obstruct a portion of light incident on each of the plurality of exit lenses 320 to allow the cut-off line CL of the beam pattern P of FIG. 6 described above to be horizontal. In other words, the cut-off line CL of the beam pattern L may be mainly formed by the light emitted through a lower portion of the plurality of exit lenses 320, and without the plurality of second shields 420, a portion of the cut-off line CL may not be horizontal as illustrated by the dotted line in FIG. 6. Therefore, glare may occur to a driver in front.

Therefore, in the exemplary embodiment of the present disclosure, by forming the plurality of second shields 420 in front of the plurality of first shields 410, the cut-off lines CL of the beam pattern P may be formed horizontally. As a result, the glare to the driver in front may be prevented.

In the exemplary embodiment, the top line of each of the plurality of second shields 420 may be disposed below the top line of the corresponding first shield of the plurality of first shields 410. This configuration is because when the top line of each of the plurality of second shields 420 is disposed at the same height or above the top line of the corresponding first shield of the plurality of first shields 410, the amount of light obstructed by the second shield increases, so that the light efficiency may decrease.

In a configuration where the plurality of first shields 410 and the plurality of second shields 420 described above are formed for each of the plurality of exit lenses 320, and two or more exit lenses correspond to one of the plurality of incident lenses 220, the light emitted from the one of the plurality of incident lenses 220 may proceed through two or more first shields and second shields.

Figure 7:
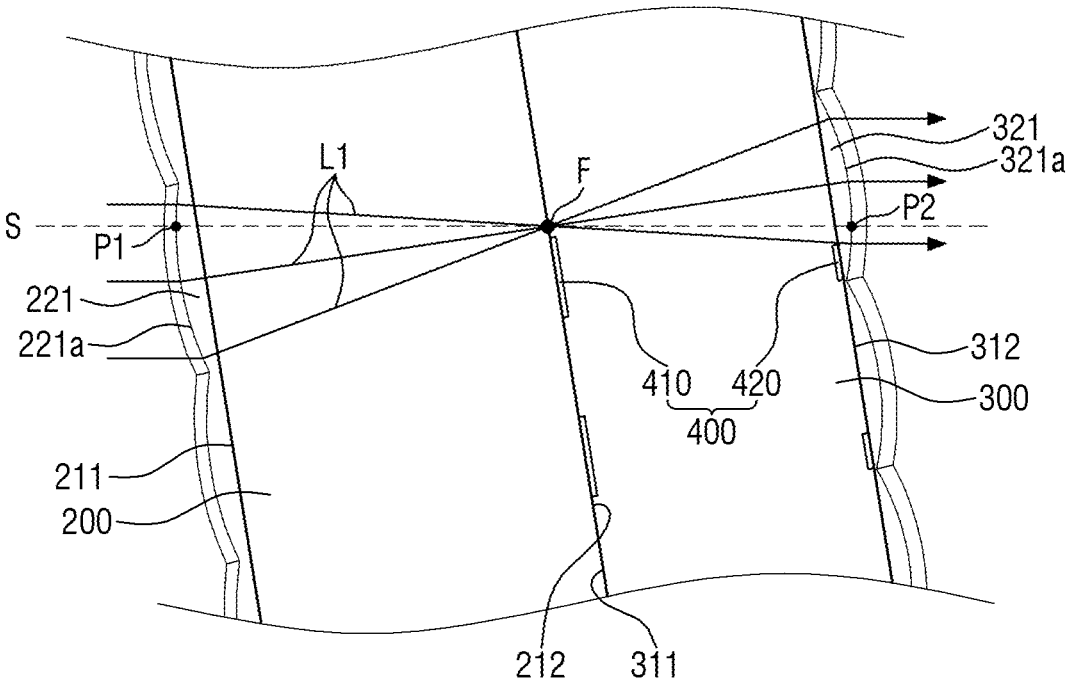
FIG. 7 is a schematic diagram showing an optical path of the vehicle lamp according to the exemplary embodiment of the present disclosure.

When the plurality of incident lenses 220 and the plurality of exit lenses 320 are arranged on the incident surface 211 of the first optical member 200 and the exit surface 312 of the second optical member 300, respectively, an incident surface 221*a* of the first incident lens 221 and an exit surface 321*a* of the first exit lens 321 may be formed asymmetrically with respect to a reference line S, which is parallel with the optical axis Ax of the light source unit 100 and passes through the focal point F between the first incident lens 221 and the first exit lens 321 as in FIG. 7. This configuration may prevent a step from forming in a direction of the optical axis Ax of the light source unit 100 between the incident lenses adjacent to each other or between the exit lenses adjacent to each other where the incident surface 211 of the first optical member 200 and the exit surface 312 of the second optical member 300 are formed to be inclined.

Here, it may be understood that the reference line S is a line that passes through the focal point F between the first incident lens 221 and the first exit lens 321 and is parallel to the optical axis Ax of the light source unit 100. Points P1 and P2 where each of the incident surface 221*a* of the first incident lens 221 and the exit surface 321*a* of the first exit lens 321 intersect with the reference line S may or may not be an inflection point in the curvature of the lenses depending on an arrangement angle of the first incident lens 221 and the first exit lens 321, or the like.

Generally, a lens is formed so that an incident surface or an exit surface is symmetrical (i.e., vertically symmetrical) with respect to a reference line that passes the focal point, and the inflection point of the incident surface or the exit surface coincides with the reference line. In such case, in order to arrange the plurality of incident lenses 220 and the plurality of exit lenses 320 in an inclined manner as in the present disclosure, a step is generated in the direction of the optical axis Ax of the light source unit 100 between adjacent lenses. Conversely, in the exemplary embodiment of the present disclosure, a step may be prevented between the incident lenses adjacent to each other or between the exit lenses adjacent to each other, so that the light may be prevented from proceeding in an unnecessary direction (e.g., scattering).

When the first incident lens 221 and the first exit lens 321 are formed asymmetrically with respect to the reference line S, one side of the incident surface 221*a* of the first incident lens 221 may have a greater area than the other side with respect to the reference line S. Similarly, the other side of the exit surface 321*a* of the first exit lens 321 may have a greater area than one side with respect to the reference line S. Therefore, light L1 emitted from the first incident lens 221 may be incident on the first exit lens 321 while the incident lenses adjacent to each other and the exit lenses adjacent to each other may be arranged in an inclined manner without a step, which may be defined as an intervening surface connecting between each lens.

Figure 8:
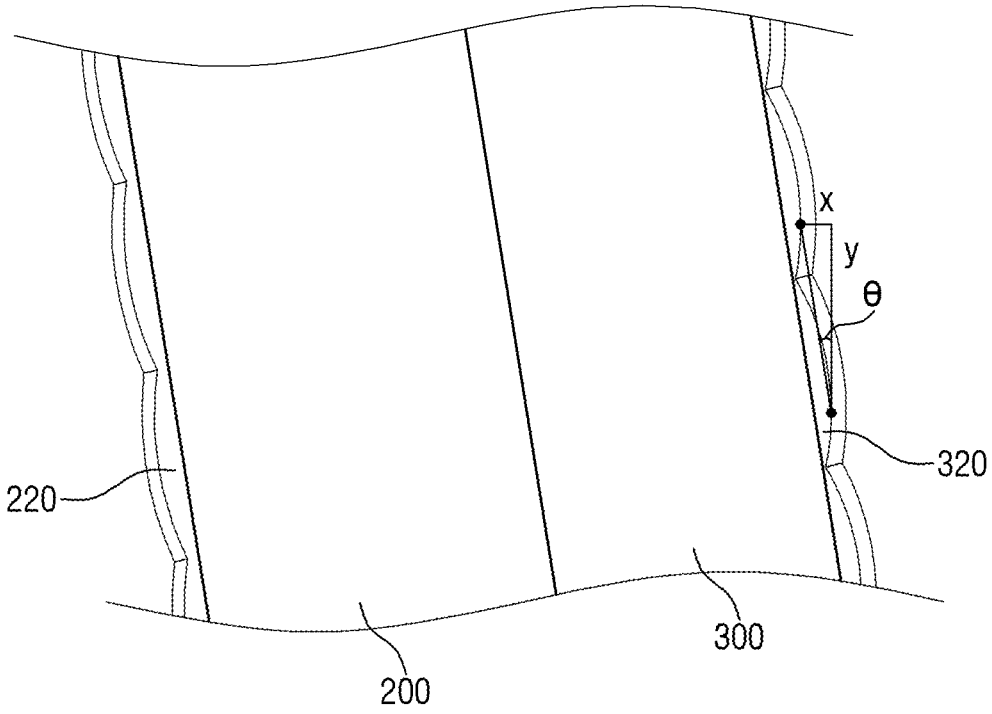
FIG. 8 is a schematic diagram showing the positional relationship between exit lenses adjacent to each other according to the exemplary embodiment of the present disclosure.

In particular, referring to FIG. 8, when a vertical distance y between the same point (for example, an inflection point, or the like) of the exit lenses adjacent to each other and an angle θ of the exit surface 312 of the second optical member 300 are determined, the exit lenses adjacent to each other may be arranged to be moved by x in the direction of the optical axis Ax of the light source unit 100, where x may be obtained by $x=y*\tan\theta$. Although FIG. 8 illustrates the exit lenses adjacent to each other as an example, the description is not limited thereto, and it may similarly be applied to the incident lenses adjacent to each other.

As described above, when the incident surface 211 of the first optical member 200 and the exit surface 312 of the second optical member 200 are formed to be inclined, the incident surface 221*a* of the first incident lens 221 and the exit surface 321*a* of the first exit lens 321 may be formed symmetrically or asymmetrically with respect to the reference line S that passes through the focal point F between the first incident lens 221 and the first exit lens 321. As a result, it may be determined whether a step occurs between the incident lenses adjacent to each other and the exit lenses adjacent to each other.

Figure 9:
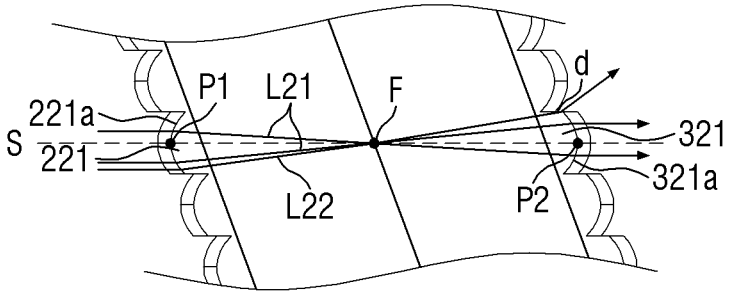
FIG. 9 is a schematic diagram showing an incident lens and an exit lens formed symmetrically or asymmetrically according to the exemplary embodiment of the present disclosure.
Figure 9:
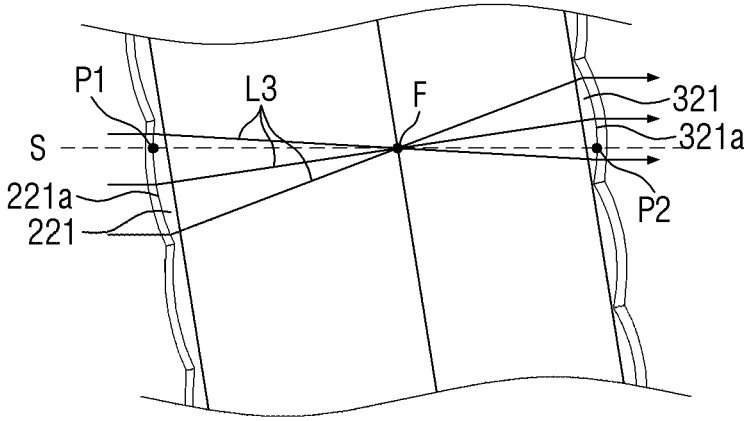

In other words, as shown in FIG. 9, when both sides are formed to be symmetrical with respect to the reference line S that passes through the focal point F between the first incident lens 221 and the first exit lens 321, it may be seen that the point P1 where the incident surface 221*a* of the first incident lens 221 and the reference line S intersect is an inflection point (e.g., the apex of concave lens or the base of convex lens) of the incident surface 221*a*, and the point P2 where the exit surface 321*a* of the first exit lens 321 and the reference line S intersect is an inflection point of the exit surface 321*a*. In order to make the incident surface 211 of the first optical member 200 and the exit surface 312 of the second optical member 300 to be inclined, a step d is required between the incident lenses adjacent to each other and the exit lenses adjacent to each other in the direction of the optical axis Ax of the light source unit 100.

Conversely, when both sides of the incident surface 221*a* of the first incident lens 221 and both sides of the exit surface 321*a* of the first exit lens 321 are formed asymmetrically with respect to the reference line S that passes through the focal point F between the first incident lens 221 and the first exit lens 321, the incident surfaces of the incident lenses adjacent to each other and the exit surfaces of the exit lenses adjacent to each other may be continuously formed without any step or an intervening surface therebetween.

Here, when the step d exists between the incident lenses adjacent to each other and the exit lenses adjacent to each other, some of light L21 incident on the first incident lens 221 may be incident on the first exit lens 321, and another light L22 may be incident on the step d and scattered or refracted upward or downward to cause glare. However, in the exemplary embodiment of the present disclosure, since no step exists between the incident lenses adjacent to each other and the exit lenses adjacent to each other, when light L3 incident on the first incident lens 221 is emitted to the first exit lens 321, the light is prevented from proceeding in an unnecessary or unintended direction, so that glare may be prevented.

As such, in the exemplary embodiment of the present disclosure, in order to ensure that the incident surfaces of the incident lenses adjacent to each other are continuously formed without a surface interposed therebetween, and the exit surfaces of the exit lenses adjacent to each other are continuously formed without a surface interposed therebetween, in the incident surface 221*a* of the first incident lens 221, an area corresponding to a direction farther from the light source unit 100 may be formed the be greater than an area corresponding to a direction closer to the light source unit 100 among the both sides (e.g., upper side and lower side) of the first optical member 200 with respect to the reference line S. Similarly, in the exit surface 321*a* of the first exit lens 321, an area corresponding to the direction closer to the light source unit 100 of both sides of the second optical member 300 may be formed to be greater than an area corresponding to a direction farther from the light source unit 100 with respect to the reference line S.

When the first incident lens 221 and the first exit lens 321 are formed asymmetrically with respect to the reference line S, the incident surface 221*a* of the first incident lens 221 and the exit surface 321*a* of the first exit lens 321 may be disposed to be vertically offset from each other. Due to this configuration, even when the incident lenses adjacent to each other and the exit lenses adjacent to each other are arranged to be inclined, the incident surfaces of the incident lenses adjacent to each other may be continuously formed without a step, and the exit surfaces of the exit lenses adjacent to each other may be continuously formed without a step.

Figure 10:
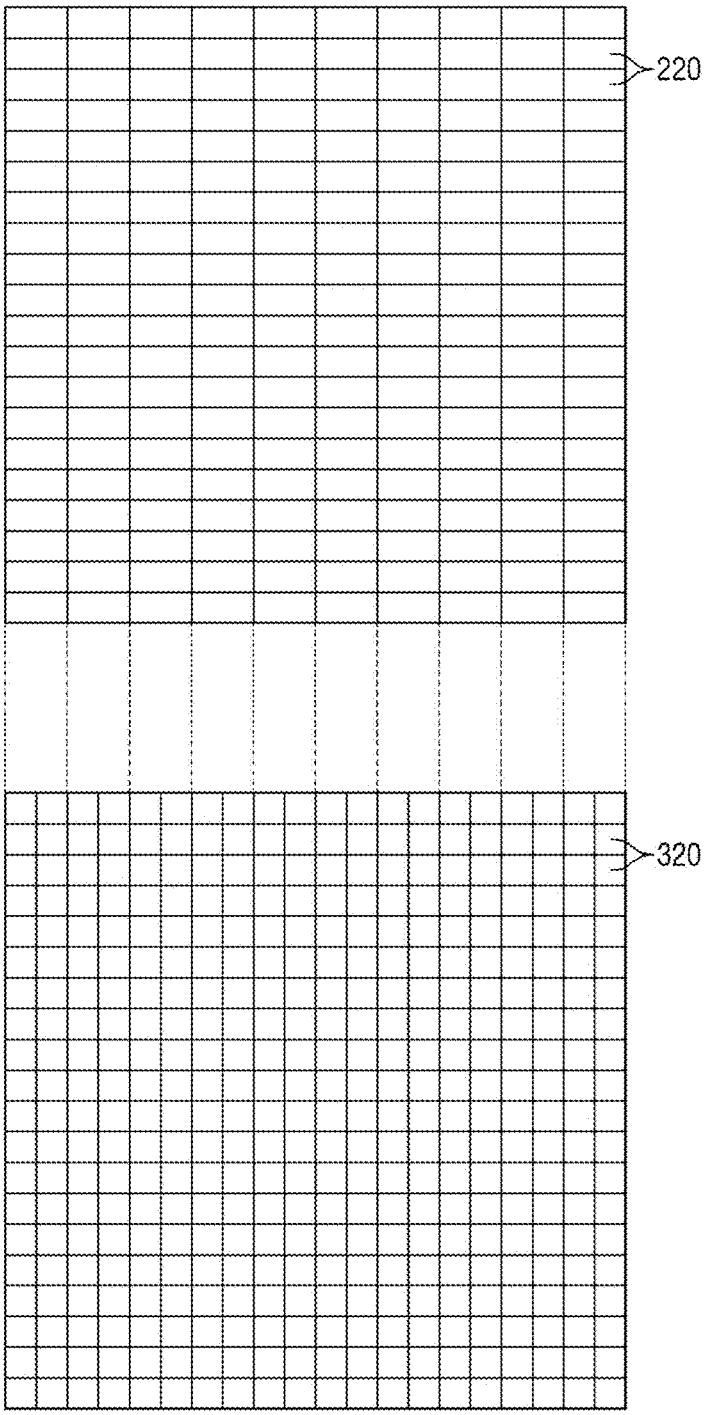
FIG. 10 is a schematic view showing the incident lens and the exit lens according to the exemplary embodiment of the present disclosure.

In the exemplary embodiment of the present disclosure, each of the plurality of incident lenses 220 may have a semi-cylindrical shape that is formed to extend in one direction, and light emitted from each of the plurality of incident lenses 220 may be incident on two exit lenses, as shown in FIG. 10. However, this is merely an example for helping the understanding of the present disclosure. The number of exit lenses corresponding to one of the plurality of incident lenses 220 may be variously changed depending on a region formed in the beam pattern P described above.

Figure 11:
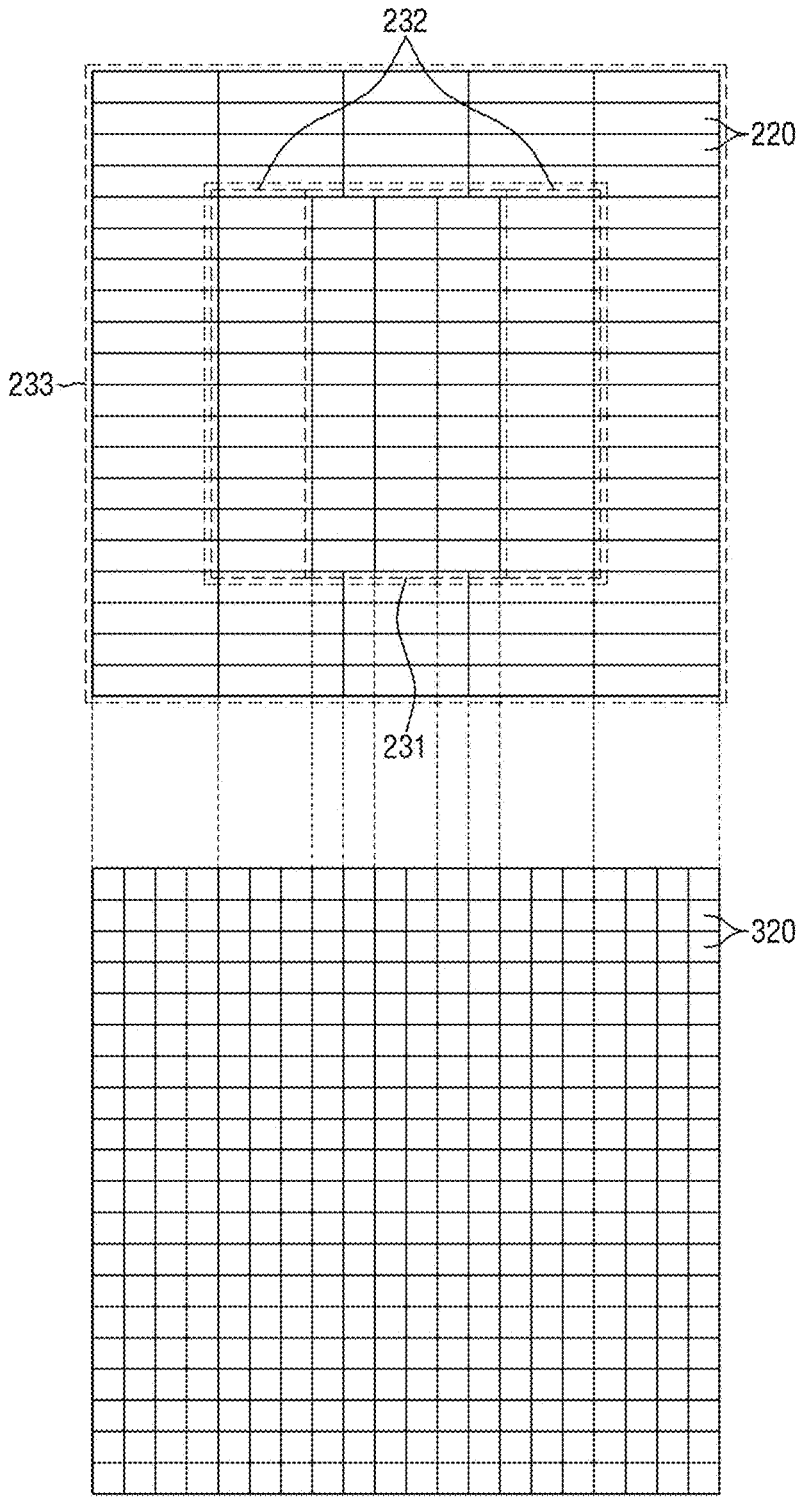
FIG. 11 is a schematic view showing an incident lens and an exit lens according to another exemplary embodiment of the present disclosure.

FIG. 11 is a schematic view showing the plurality of incident lenses and the plurality of exit lenses according to another exemplary embodiment of the present disclosure. Referring to FIG. 11, in the vehicle lamp 1 according to the another exemplary embodiment of the present disclosure, the incident surface 211 of the first optical member 200 may include a central region 231, lateral regions 232 disposed on both sides of the central region 231, and an outer region 233 disposed outside the central region 231 and the lateral regions 232. In particular, the number of exit lenses arranged to correspond to an incident lens may be different in the regions 231, 232, and 233.

In the exemplary embodiment of the present disclosure, the number of exit lenses arranged to correspond to an incident lens may be greater in the lateral regions 232 than the central region 231, and the number of exit lenses arranged to correspond to an incident lens may be greater in the outer region 233 than the lateral regions 232.

For example, the light emitted from an incident lens disposed in the central region 231 may be incident on two exit lenses, the light emitted from an incident lens in the lateral regions 232 on both sides of the central region 231 may be incident on three exit lenses, and the light emitted from an incident lens in the outer region 233 outside the central region 231 and the lateral regions 232 may be incident on four exit lenses.

Figure 12:
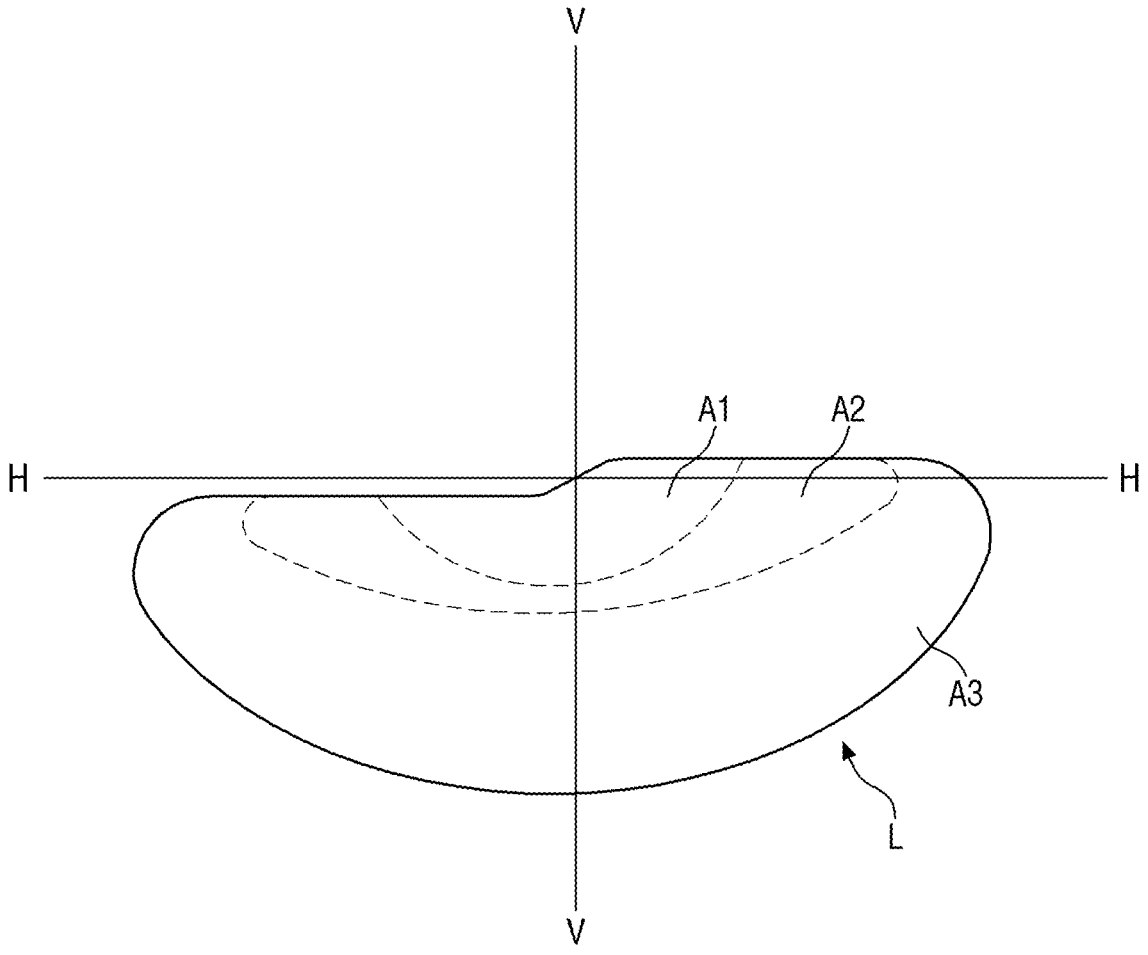
FIG. 12 is a schematic diagram showing a beam pattern formed by the incident lens and the exit lens according to the another exemplary embodiment of the present disclosure.

The central region 231, the lateral regions 232, and the outer region 233 described above may serve to form different regions of the beam pattern L shown in FIG. 6 described above. For example, as shown in FIG. 12, the central region 231 may form a high illuminance region A1 of the beam pattern L, the lateral regions 232 may form a spread region A2 that extend from side to side in the high illuminance region A1, and the outer region 233 may form an extended spread region A3 that expands the spread region A2.

The central region 231, the lateral regions 232, and the outer region 233 described above are merely examples for helping understanding of the present disclosure, and the present disclosure is not limited thereto. The number and/or position of the central region 231, the lateral regions 232, and the outer region 233 may be variously changed depending on a beam pattern to be formed through the vehicle lamp 1 of the present disclosure. The number of exit lenses corresponding to one of the plurality of incident lenses 220 in each region may be variously changed.

In concluding the detailed description, those skilled in the art will appreciate that many variations and modifications can be made to the exemplary embodiments without substantially departing from the principles of the present disclosure. Therefore, the disclosed exemplary embodiments of the disclosure are used in a generic and descriptive sense only and not for purposes of limitation.

What is claimed is:

1. A vehicle lamp, comprising:

a light source unit;

a first optical member in which a plurality of incident lenses are arranged on an incident surface thereof to which light generated from the light source unit is incident;

a second optical member in which a plurality of exit lenses are arranged on an exit surface thereof from which the light incident from the first optical member is emitted; and a shield unit including a plurality of shields disposed between the plurality of incident lenses and the plurality of exit lenses, wherein a direction perpendicular to the incident surface of the first optical member and the exit surface of the second optical member is inclined by a predetermined angle greater than 0° with respect to an optical axis of the light source unit to allow a top side of the first optical member to be closer to the light source unit than a bottom side of the first optical member and to allow a top side of the second optical member to be closer to the light source unit than a bottom side of the second optical member, wherein an incident surface of a first incident lens among the plurality of incident lenses and an exit surface of a first exit lens that corresponds to the first incident lens among the plurality of exit lenses are formed asymmetrically with respect to a first reference line drawn to pass through a focal point disposed between the first incident lens and the first exit lens, the first reference line being parallel with the optical axis of the light source unit, and wherein an upper portion and a lower portion of the incident surface of the first incident lens have substantially equal heights with respect to a second reference line connecting an inflection point of the first incident lens and an inflection point of the first exit lens, and an upper portion and a lower portion of the exit surface of the first exit lens have substantially equal heights with respect to the second reference line, the second reference line being inclined from the first reference line by the predetermined angle.

2. The vehicle lamp of claim 1, wherein the shield unit comprises:

a plurality of first shields configured to obstruct a portion of light incident on the plurality of exit lenses; and a plurality of second shields disposed in front of the plurality of first shields.

3. The vehicle lamp of claim 2, wherein the plurality of first shields and the plurality of second shields are formed on an incident surface and an exit surface of one of the first optical member or the second optical member.

4. The vehicle lamp of claim 2, wherein a top line of each of the plurality of first shields is disposed at or near a focal point between corresponding incident lens and exit lens among the plurality of incident lenses and the plurality of exit lenses.

5. The vehicle lamp of claim 2, wherein a top line of each of the plurality of second shields is disposed below a top line of a corresponding first shield among the plurality of first shields.

6. The vehicle lamp of claim 1, wherein an exit surface of the first optical member and an incident surface of the second optical member abut each other to form an interface, and wherein the focal point is formed at the interface between the first optical member and the second optical member.

7. The vehicle lamp of claim 1, wherein an incident surface of each of the plurality of incident lenses is continuously formed with an incident surface of an adjacent incident lens without a surface interposed therebetween, and wherein an exit surface of each of the plurality of exit lenses is continuously formed with an exit surface of an adjacent exit lens without a surface interposed therebetween.

8. The vehicle lamp of claim 1, wherein the first incident lens and the first exit lens are offset from each other with respect to the first reference line.

9. The vehicle lamp of claim 1, wherein an upper portion of the incident surface of the first incident lens has a smaller height than a lower portion thereof with respect to the first reference line, and wherein an upper portion of the exit surface of the first exit lens has a greater height than a lower portion thereof with respect to the first reference line.

10. The vehicle lamp of claim 1, wherein each of the plurality of incident lenses is a semi-cylindrical lens that extends in a predetermined direction, and wherein light emitted from each of the plurality of incident lenses is incident on at least two of the plurality of exit lenses.

11. The vehicle lamp of claim 1, wherein the incident surface of the first optical member includes a central region, lateral regions disposed on both sides of the central region, and an outer region disposed outside the central region and the lateral regions, and wherein numbers of exit lenses arranged to correspond to an incident lens increase in the order of the central region, the lateral regions, and the outer region.

12. The vehicle lamp of claim 11, wherein light emitted from an incident lens in the central region is incident on two exit lenses, wherein light emitted from an incident lens in the lateral regions is incident on three exit lenses, and wherein light emitted from an incident lens in the outer region is incident on four exit lenses.

13. The vehicle lamp of claim 11, wherein the central region forms a high illuminance region of a beam pattern, wherein the lateral regions form a spread region of the beam pattern, and wherein the outer region forms an extended region of the beam pattern that expands the spread region.

14. A vehicle lamp, comprising:

a light source unit;

a first optical member in which a plurality of incident lenses are arranged on an incident surface thereof to which light generated from the light source unit is incident;

a second optical member in which a plurality of exit lenses are arranged on an exit surface thereof from which the light incident from the first optical member is emitted; and a shield unit including a plurality of shields disposed between the plurality of incident lenses and the plurality of exit lenses, wherein a direction perpendicular to the incident surface of the first optical member and the exit surface of the second optical member is inclined by an angle greater than 0° with respect to an optical axis of the light source unit to allow a first peripheral side of the first optical member to be closer to the light source unit than a second peripheral side of the first optical member, the second peripheral side being opposite from the first peripheral side with respect to the optical axis, and to allow a first peripheral side of the second optical member to be closer to the light source unit than a second peripheral side of the second optical member, the second peripheral side being opposite from the first peripheral side with respect to the optical axis, wherein an incident surface of a first incident lens among the plurality of incident lenses and an exit surface of a first exit lens that corresponds to the first incident lens among the plurality of exit lenses are formed asymmetrically with respect to a reference line drawn to pass through a focal point disposed between the first incident lens and the first exit lens, wherein the incident surface of the first optical member includes a central region, lateral regions disposed on both sides of the central region, and an outer region disposed outside the central region and the lateral regions, and wherein numbers of exit lenses arranged to correspond to an incident lens increase in the order of the central region, the lateral regions, and the outer region.

* * * * *